United States Patent [19]

Aspin

[11] 4,056,418

[45] Nov. 1, 1977

[54] PROCESS FOR MAKING HOLLOW FIBERS

[75] Inventor: Frank M. Aspin, Knutsford, England

[73] Assignee: Shell Oil Company, Houston, Tex.

[21] Appl. No.: 574,652

[22] Filed: May 6, 1975

[30] Foreign Application Priority Data

May 8, 1974 United Kingdom ..... 20198/74

[51] Int. Cl.[2] ..... B32B 31/08; B32B 31/18; B29D 7/24; D01D 5/24

[52] U.S. Cl. ..... 156/145; 156/229; 156/269; 264/159; 264/173; 264/DIG. 47

[58] Field of Search ..... 264/147, 173, 167, 248, 264/DIG. 47, 95, 159; 425/510, 515, 520, 335, 363; 156/145, 156, 210, 229, 285, 292, 269

[56] References Cited

U.S. PATENT DOCUMENTS

| | | | |
|---|---|---|---|
| 1,349,560 | 8/1920 | Cobb | 264/248 |
| 3,158,181 | 11/1964 | Gore | 156/292 |
| 3,273,771 | 9/1966 | Beaumont | 264/DIG. 47 |
| 3,470,685 | 10/1969 | Hall et al. | 264/DIG. 47 |
| 3,494,522 | 2/1970 | Kim et al. | 264/DIG. 47 |
| 3,530,029 | 9/1970 | Lemelson | 425/515 |
| 3,574,804 | 4/1971 | Joonase | 264/147 |
| 3,919,377 | 11/1975 | Dow et al. | 264/147 |

*Primary Examiner*—James B. Lowe

[57] ABSTRACT

Process and apparatus for the manufacture of hollow fibers are disclosed in which at least two layers of molecularly orientable thermoplastic material are together passed through a pressure nip between two rollers, each of which has in its periphery annular grooves with lands therebetween, the grooves in the respective rollers being accurately aligned, whereby the layers are caused to form at least the boundaries of enlarged portions which are connected by thin integral portions or completely severed from each other. Any interconnected enlarged portions are then separated by mechanical means.

6 Claims, 2 Drawing Figures

PROCESS FOR MAKING HOLLOW FIBERS

BACKGROUND OF THE INVENTION

The production of fibers by the fibrillation of oriented film has been a process available to the market for considerable time; however, fibers produced by fibrillation have not been fully accepted by the fiber industry due to the lack of proper hand and resiliency. This is particularly true concerning the use of polyolefin fibers such as polypropylene fibers in the carpeting industry. While polypropylene fibers have been used in some indoor-/outdoor carpeting, the lack of resiliency have retarded their extensive use.

The present invention concerns a process and apparatus for making fibrillated hollow fibers from film. These hollow fibers exhibit improved hand and resiliency.

SUMMARY OF THE INVENTION

A process for making hollow fibers comprises (a) simultaneously passing at least two molecularly orientable plastic films through a pressure nip between two rollers, said plastic films being at or above their fusion temperature at least at the point where the films come in contact with said rollers, said rollers having peripheral annular grooves with lands therebetween, the grooves and the lands in the respective rollers being accurately aligned so that the lands of each roller are in the same planes cutting the circumference of the roller, so that the films are fused together at the point they contact the lands, (b) cooling the fused films below the fusion temperature of the molecularly orientable plastic, and (c) stretching the fused films and treating the stretched film so as to cause the fused oriented film to fibrillate.

An apparatus for making hollow fibers comprises (a) two rollers having peripheral annular grooves with lands therebetween, the rollers being mounted so as to have a pressure nip between them and aligned so that the lands of each roller are in the same planes through the circumference of the rollers, (b) a means for cooling the fused films; (c) a means for stretching the fused cooled films; and (d) a means for treating the stretched films so as to cause fibrillation into fibers.

DESCRIPTION OF THE PREFERRED EMBODIMENTS

Figure 1:
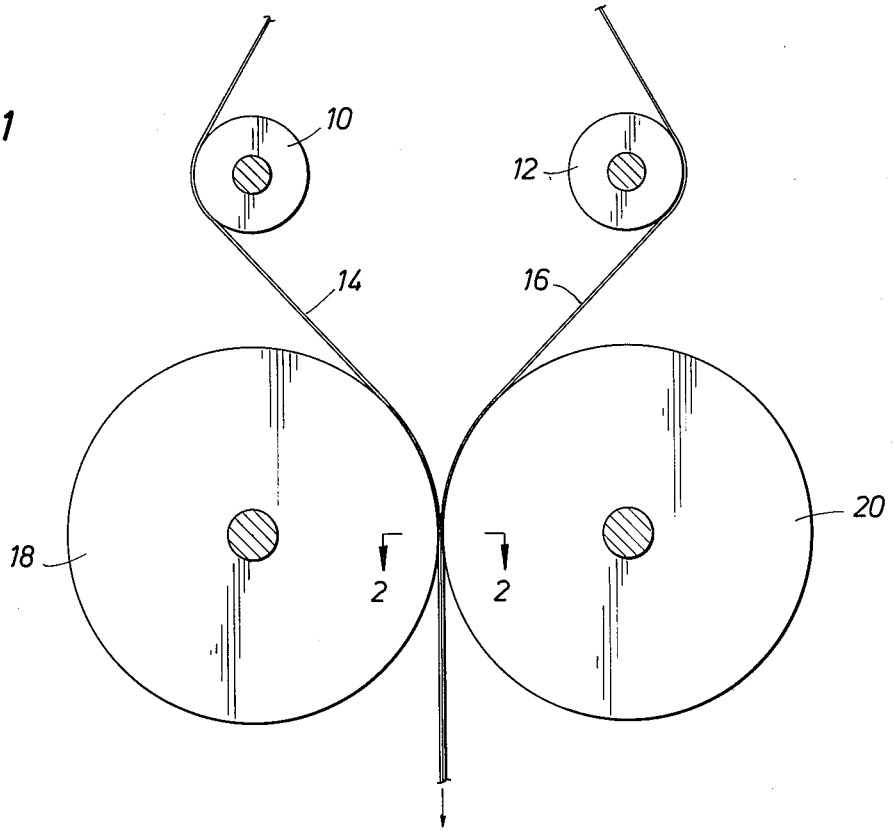

This invention concerns the treatment of the films of plastic material, which can be produced with such characteristics that when stretched in a given direction by an appropriate amount and under appropriate conditions become so weakened in a direction transverse to the direction of stretch that they can readily be divided to provide longitudinal strands, and so strengthened in the direction of stretch that the strands have a strength adequate for textile applications. The words "textile applications" are to be understood in a broad sense: for example, the conversion of the strands into, or the use of the strands as, cord, twine, thread and yarn is contemplated. However, the strands have applications which are other than textile in nature.

The plastic films should be made of a molecularly orientable plastic and preferred plastics are polypropylene, polyethylene and polyamides but any molecularly orientable plastic can be used.

According to the present invention at least two layers of film of plastic material are together passed through a pressure nip between two rolls. Each of the rolls has in its periphery annular grooves with lands therebetween, said grooves in the respective rolls being accurately aligned, so that the lands of each roller are in the same planes running through the circumference of the rollers whereby the film layers are caused to form at least the boundaries of enlarged portions connected by thin integral portions or completely severed from each other. Thus if two films only are used the enlarged portions will be hollow. If three films are used the enlarged portions will each have two hollow parts separated by the third layer of film.

While it is preferred that both rolls have grooves with the lands of each in the same plane running through the circumference of the rollers it is also possible to carry out the process of the invention where only one of the two rolls has grooves and lands, the other having a non-yielding surface. Hollow fibers formed with this pair of rolls have one flat side and one rounded side.

The temperature of the films at the point they come into contact with the lands must be at or above the fusion temperature of the plastic (in most instances the fusion temperature equals the melting temperature). This can be accomplished by either feeding film which has been heated to a temperature at or above its fusion temperature or by heating the grooved rollers. The heating of the rollers can be done either through the use of internally circulated fluids such as steam or hot oil or by electrical heating.

While in most cases the air trapped between the films keeps the films apart except where forced together by the lands of the grooved rollers, a preferred method of ensuring that the fibers remain hollow is to blow a gas such as air between the films at the point they enter the grooved rollers, thus creating a slight pressure to ensure the films do not collapse on each other. A simple air knife is a suitable device for carrying out this variation.

The fused film is then passed from the grooved rollers to a means for cooling. The means can be simply passing the film over cooling rollers in which a coolant is internally circulated or could include subjecting the fused film to a stream of cooled air.

Once the fused film has reached a temperature below its fusion temperature it is stretched to a length of from about 2 to about 12 times its original length, preferably about 2 to about 7 times its original length in order to molecularly orient the film. This is usually accomplished by passing the film between two sets of rollers, the final set of rollers being run at a speed faster than the first set of rollers. Care should be taken to ensure that the pressure between the sets of rollers is not so high that it causes the hollow sections of the film to collapse. One method of ensuring this is to use stretch rollers with grooved surfaces matching those of the rollers used to cause the fusion of the films. Another method of ensuring this is to use stretching rollers having a yielding surface. The fibrillation or separation of the fused film into fibers is caused by mechanically striking the stretched film with brushes, needles or the like or by impinging on it with a blast of air. Normally the mechanical handling during stretching will cause the films to split into fibers.

The invention also includes apparatus for carrying out the process as described above.

The invention will now be illustrated further, by way of example only, with reference to the accompanying drawings.

Figure 2:
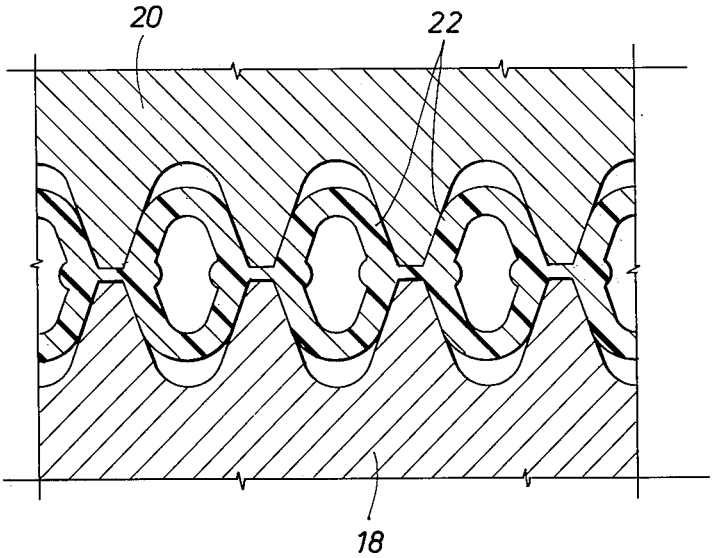

FIG. 1 is a diagram of one form of apparatus according to the invention and illustrates the process according to the invention, and FIG. 2 is a detail view of parts of the apparatus of FIG. 1.

Referring first to FIG. 1, two guide rolls 10 and 12 direct two sheets of film 14 and 16 to the nip between embossing rolls 18 and 20. The embossing rolls 18 and 20 are provided with heating means (not shown). Means for feeding the films to the apparatus, for collecting treated film therefrom and for driving the embossing rolls 18 and 20 are provided (also not shown).

FIG. 2 is a detail cross-sectional view through the nip between embossing rolls 18 and 20. As will be seen, each groove is of generally V-shape, with a rounded bottom, and there are lands separating adjacent grooves. Rolls can have between about 15 to about 60 grooves per inch, preferably between about 15 to about 40, and the width of each land may be about 0.0015 inches or less. With the shape of grooves as shown, enlarged portions 22 of fused film having hollow interiors result which are connected by a thin integral part of fused film between each pair of aligned lands, as by the welding together of the two films at these locations.

By later stretching at a temperature below the fusion or melting temperature of the films the cross-sectional shape of the enlarged portions are modified, the strength thereof increased in their longitudinal directions, and, if previously connected, the portions are separated by fibrillation of the connecting parts into individual strands which can be regarded as textile fibers.

By using films of different physical characteristics fibers are formed with different shrinkage potential when subjected to heat for the production of crimped fiber.

More than two films may be used with obvious modification of the cross-sectional shape of the enlarged portions.

By using different groove cross-sections different fiber shapes can be achieved. Thus with sharper V-shapes, fibers of generally diamond-shaped cross-section may be produced, and the tendency of the sides of the diamond to become concave together with the hollow construction enables very "springy" fibers to be made, which are very suitable for use in carpet piles.

The preferred film to use in the process is a blown film (that is produced in the form of a tube) and not to slit the sides before embossing. In this way entrapped air is utilized to aid in the formation of hollow filaments.

I claim as my invention:

1. A process for making hollow fibers which comprises (a) simultaneously passing at least two molecularly orientable plastic films through a pressure nip between two rollers, said plastic films being at or above their fusion temperature at least at the point where the films come in contact with said rollers, said rollers having from 15 to 60 peripheral annular grooves per inch with lands of no more than about 0.0015 inch width therebetween, the grooves in the respective rollers being accurately aligned so that the lands of each roller are in the same planes cutting the circumference of the roller, so that the films are fused together at the point they contact the lands and are kept apart by air trapped between the films in the non-fused area, (b) cooling the fused films below the fusion temperature of the molecularly orientable plastic, (c) stretching the fused films and treating the stretched film so as to cause the fused films to fibrillate.

2. The process of claim 1 wherein the grooved rollers are heated to a temperature sufficient to fuse the films at the point they contact the lands.

3. The process of claim 2 wherein the cooling step is accomplished by contacting the film with a roller in which a cooling liquid is circulated.

4. The process of claim 3 wherein the stretching is accomplished by pulling the fused cooled film through a pair of nip rollers whose speed is from about 2 to about 15 times the speed of the cooling roller.

5. The process of claim 4 where the orientable plastic film is made of polypropylene.

6. The process of claim 1 wherein there are three plastic films.

* * * * *